US006227136B1

(12) United States Patent
Shapiro

(10) Patent No.: US 6,227,136 B1
(45) Date of Patent: May 8, 2001

(54) FLOATING OBJECT STABILIZATION AND RESTRAINING SYSTEM

(76) Inventor: Barry Shapiro, Two Fifth Ave., New York, NY (US) 10001

( * ) Notice: Subject to any disclaimer, the term of this patent is extended or adjusted under 35 U.S.C. 154(b) by 0 days.

(21) Appl. No.: 09/577,285

(22) Filed: May 23, 2000

Related U.S. Application Data

(60) Provisional application No. 60/188,530, filed on Mar. 10, 2000.

(51) Int. Cl.[7] ..... B63B 21/00

(52) U.S. Cl. ..... 114/230.2; 114/230.27

(58) Field of Search ..... 114/125, 39.23, 114/230.1, 230.15, 230.19, 230.2, 230.21, 230.22, 230.24, 230.27

(56) References Cited

U.S. PATENT DOCUMENTS

| | | | | |
|---|---|---|---|---|
| 2,440,972 | | 5/1948 | Peltier | 114/230 |
| 3,060,884 | * | 10/1962 | Wood | 114/230.2 |
| 4,357,009 | | 11/1982 | Baker | 272/119 |
| 4,690,399 | * | 9/1987 | Hayashi | 272/122 |
| 5,265,553 | * | 11/1993 | Brydges | 114/230 |
| 6,099,441 | * | 8/2000 | Bonnet | 482/93 |

* cited by examiner

*Primary Examiner*—Ed Swinehart
(74) *Attorney, Agent, or Firm*—Gottlieb, Rackman & Reisman, P.C.

(57) ABSTRACT

An automatically adjusting mooring system that is light-weight and flexible for storing in small spaces comprises a water weight bag made of a flexible and durable material, a pulley and a line. The pulley is hung on a floating object and the line run through the pulley. One end of the line is tied to a stationery object and the other end to a water weight bag. The water weight bag is filled to the desired level to provide the weight and tension necessary to keep the line taut an maintain the floating object in a safely docked position.

13 Claims, 4 Drawing Sheets

FLOATING OBJECT STABILIZATION AND RESTRAINING SYSTEM

This application claims benefit of provisional application Ser. No. 60/188,530 filed Mar. 10, 2000.

FIELD OF THE INVENTION

This invention relates to methods and apparatus for securing floating objects to a stationary support. More particularly it relates to methods and apparatus for automatically adjusting a floating object restraining system to compensate for the effects of tidal motion upon the floating objects.

BACKGROUND OF THE INVENTION

Boats, when not sailing, are typically anchored to the sea floor or moored to a heavy weight on the sea floor, or secured to a dock. In the case of anchoring or mooring there must be slack in the anchor line or mooring line to accommodate tidal motion which raises and lowers the boat relative to the sea floor and to avoid upward forces that could dislodge the anchor or mooring. This slack necessitates that the boat have room to move without colliding into other boats. On the other hand, a boat may be secured to a dock that is not itself subject to tidal motion. It is not desirable to attach the boat to the dock with a slack rope, since that will both allow the boat to take up more space at the dock and to slam into the dock in response to shifting wind and currents. Unless the lines securing the boat to the dock are constantly adjusted to maintain the boat in its safely docked position, the mooring lines will become too loose or too tight with the changing tides, moving the boat around and causing damage as the boat floats into the dock. It is necessary therefore to arrange that as the tide rises and falls the ropes securing the boat to the dock take up their slack in the rope. This has been accomplished in the past by a system of pulleys and weights. That system, however, suffers from the drawback that it requires the boat to carry the weights needed for tying to the dock. Those weights must be heavy enough to provide a tension in the line great enough to restrain the boat. Carrying such weights is a significant inconvenience, especially in a small boat Thus, it is desirable to provide a lightweight, compact weight and pulley system that automatically adjusts mooring lines to keep floating objects in place against a dock or seawall to accommodate changing water levels.

U.S. Pat. No. 2,440,972 discloses a mooring device using a rope attached to weight to compensate for tidal motion. U.S. Pat. No. 3,060,884 discloses a boat moored to a floating dock where both the dock and the boat are moored with weight that compensate for tidal motion. U.S. Pat. No. 4,357,009 shows a weight bag which is water filled. None of these references suggest the combination of water filled weight bags with mooring systems.

BRIEF DESCRIPTION OF THE INVENTION

In accordance with the principles of the present invention, there is provided an automatically adjusting restraint system for floating objects such as boats or piers comprising water filled weight bags, a pulley system and lines. The pulley is secured either to the stationary dock or to the floating object, such as a pier or boat. The line is run between the stationary object, the floating object and the water filled weight so that any slack in the line caused by the motion of the floating object is taken up by the water filled weight.

The water bag can be filled to various levels to provide different amounts of tension in the line according to the size or desired position of the object to be secured.

The water weight bag is made of a soft, durable and lightweight material that can be folded into a small manageable size for storage in small spaces.

BRIEF DESCRIPTION OF THE DRAWINGS

The following description can be better understood in conjunction with the drawings in which.

DETAILED DESCRIPTION

Figure 1B:
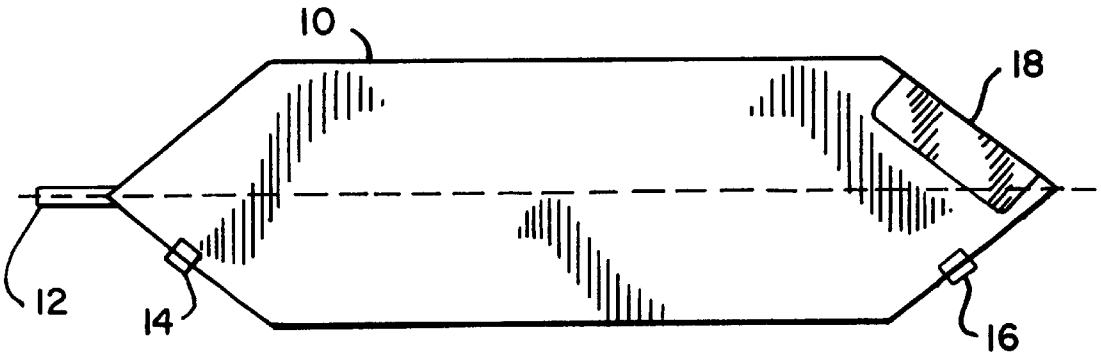
FIG. 1*b* is a side view of a fill and open water weight bag according to the principles of the present invention.
Figure 1C:
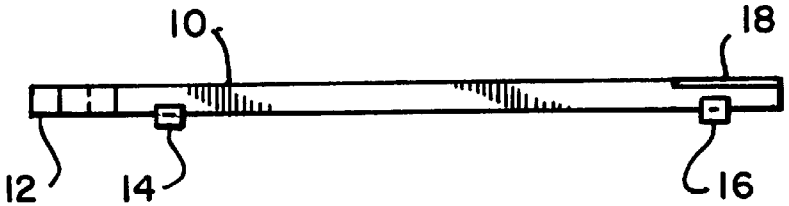
FIG. 1*c* is a side view of a flat and empty water weight bag according to the principles of the present invention.
Figure 1A:
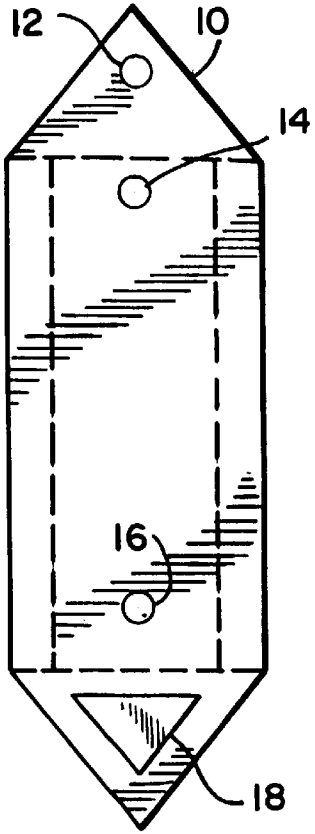
FIG. 1*a* is a front view of a flat and empty water weight bag according to the principles of the present invention.

Referring to FIG. 1*a,* there is shown a front view of an empty water weight bag according to the principles of the present invention generally indicated by 10. The bag 10 should be made of soft vinyl or a similar material that is lightweight and flexible so the bag can be folded flat and stored in small places. The bag can be made in different sizes to accommodate different size loads. A reasonable set of sizes would hold 7 lb., 10 lb., 15 lb, 20 lb, etc. of water. A grommet 12 provides an opening for a line (not shown) to be tied through. A filler opening 14 is provided on the top of the bag 10 to fill the bag 10 with water. An adjusting valve 16 on the bottom of the bag 10 is provided to drain water for adjusting the weight of the bag 10. A lead weight 18 adds extra weight to the bag 10.

The adjusting valve 16 permits a boat's position along the dock to be controlled as described below in connection with FIG. 5. As water is drained from the bag through the valve 16, the bag will fold at the top and air will not enter the bag making it more buoyant.

FIG. 1*b* is a side view of the bag 10 when full of water. FIG. 1*c* shows the bag 10 flat and empty from the side.

Figure 2A:
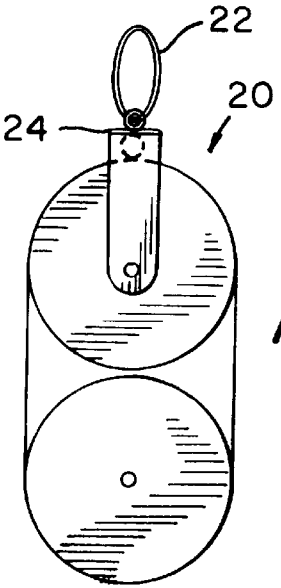
FIG. 2*a* depicts a double roller pulley well known in the art.

FIG. 2*a* shows a double roller pulley 20 used in the present invention and well known in the art. A line guide holder 22 is attached to a swivel 24.

Figure 2B:
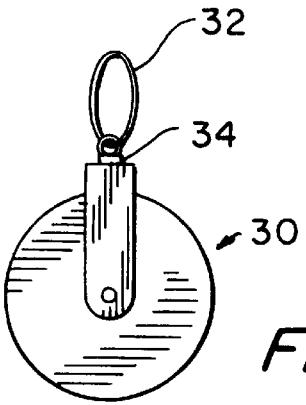
FIG. 2*b* depicts a single roller pulley well known in the art.

Now referring to FIG. 2*b,* there is shown a single roller pulley 30, also well know in the art, with a line guide holder 32 and a swivel 34.

Figure 3:
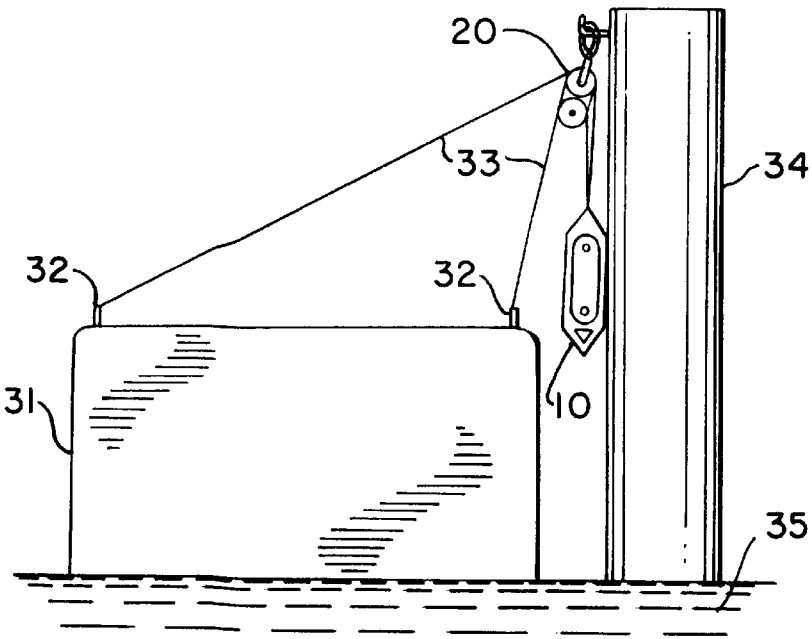
FIG. 3 depicts one arrangement of the water weight mooring system of the present invention.

FIG. 3 shows one embodiment of the present invention where a floating object 31 is moored to a post 34. The object shown could be the stem of a boat or a dock. A double roller pulley 20 is hung from the post 34 with mooring lines 33 through it. One end of the mooring 20 lines 33 are tied to hooks 32 on the object 31 at one end and passed through the grommet in a water weight bag 10 at the other end, or passed through a pulley at the bag (not shown). It is permissible to allow the bag to submerge in the water due to the rope length. Although doing so will lessen the force exerted by the bag on the rope due to the buoyant force exerted by the water outside the bag, this is compensated by a weight in the bag that will lessen the buoyancy of the bag. As the water level rises and falls, the object 31 will also rise and fall. The bag 10 rises and falls with the water levels as well, keeping a constant tension on the mooring lines 33, thereby keeping the object 31 in its proper position.

Figure 4:
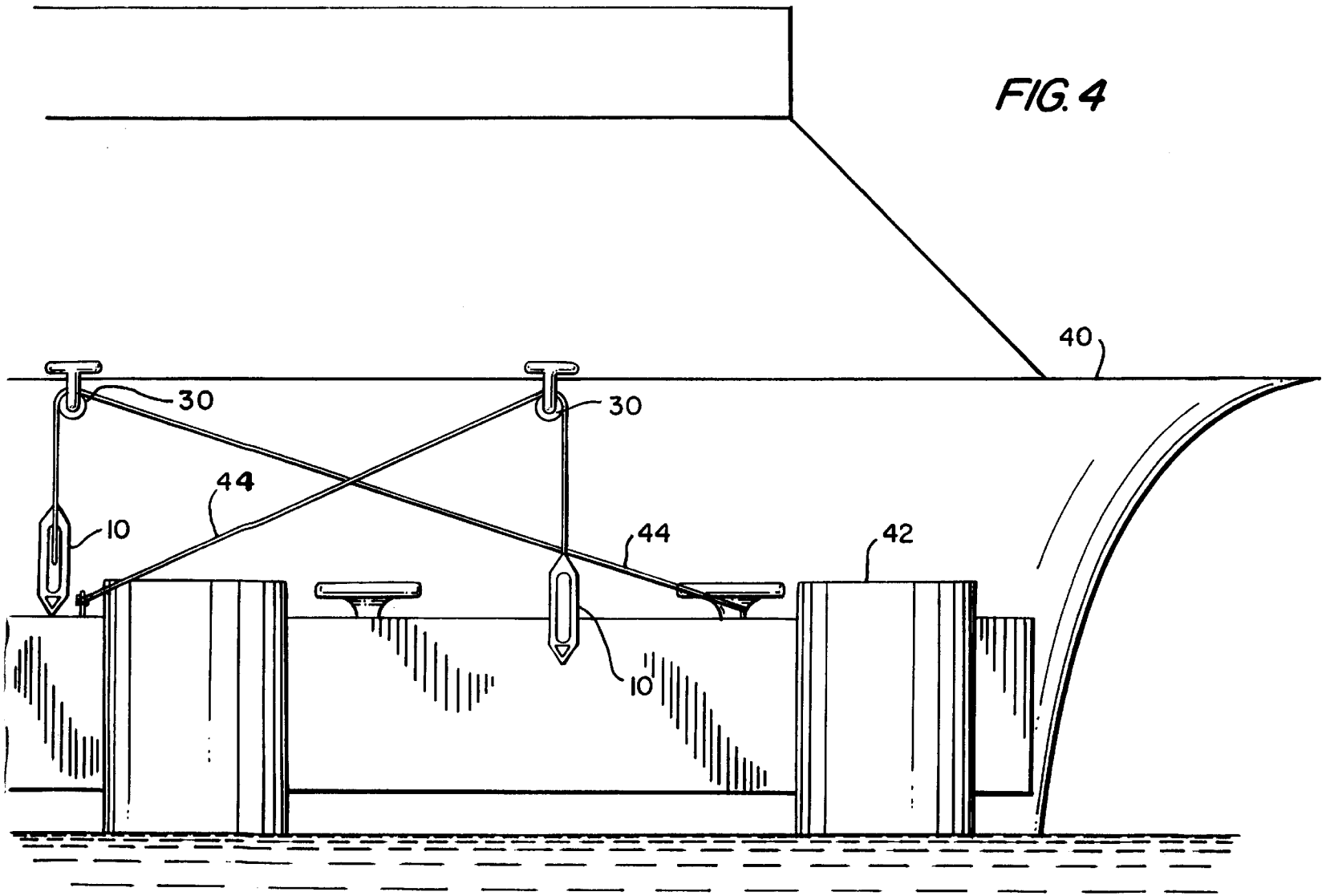
FIG. 4 depicts an alternative arrangement of the water weight mooring system of the present invention; and, FIG. 5 depicts another arrangement of the water weight mooring system of the present invention.

FIG. 4 shows an alternative arrangement of the present invention where the pulleys 30 are hung from a boat 40, or any floating object Mooring lines 44 are run through the pulleys 30 and tied at one end to cleats on a stationery dock 42. The other end of the lines 44 are tied to a water weight bag 10. As the water level rises and falls, so will the boat 40. The water weight bags will provide constant tension in the lines 44 to keep the boat 40 in its proper docked position.

Figure 5:
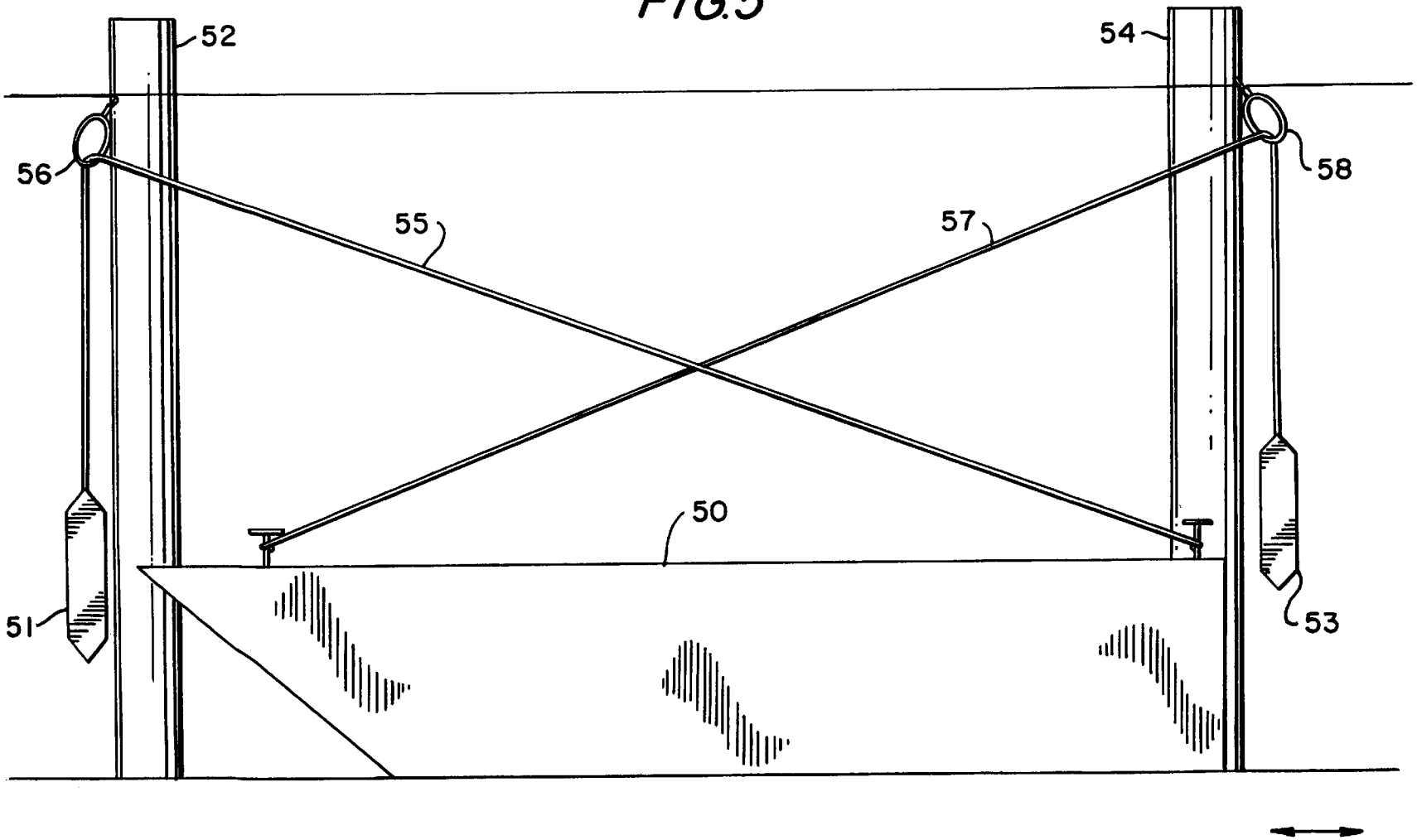

Referring to FIG. 5, there is shown an alternative arrangement in accordance with the principles of the present invention. A boat 50 is docked to posts 52 and 54. The prow of the boat 50 is moored to post 54, positioned aft of the boat 50. Mooring line 57 is tied to the prow of the boat 50 and run through a pulley 58 and tied to water weight bag 53. The stem of the boat is moored to post 52, positioned in prow of the boat 50. Mooring line 55 is run through a pulley 56 and attached to a water weight bag 51. The boat will move until the horizontal components of the forces exerted by the tension in the lines is equal. The particular setup in FIG. 5 allows for adjusting the boat's 50 position by utilizing the adjusting valve 16 to change the amount of water in the bags 51 and 53. More water in one bag will weigh heavier on the mooring line to which it is attached and pull the boat 50 in its direction. In this way, the distribution of weight between the front and back weight bags 51 and 53 as controlled by the adjusting valves will determine the boat's 50 position between the two posts 52 and 54 while automatically adjusting for the change in the tides.

The description disclosed in this specification is meant to illustrate a preferred embodiment and the principles of the present invention and not to limit its uses or application.

What is claimed is:

1. An automatically adjusting mooring system using water weight bags comprising:

a line having a first end and a second end,;

a pulley attached to a floating object; and, a water weight bag made of a soft and flexible material, wherein said line is run through said pulley with said first end tied to said water weight bag and said second end tied to a stationery object.

2. The automatically adjusting mooring system of claim 1 wherein said pulley is a single roller pulley.

3. The automatically adjusting mooring system of claim 1 wherein said pulley is a double roller pulley.

4. The automatically adjusting mooring system of claim 1 wherein the floating object is a boat.

5. The automatically adjusting mooring system of claim 1 wherein the floating object is a dock.

6. The automatically adjusting mooring system of claim 1 wherein the soft and flexible material further comprises a soft vinyl.

7. An automatically adjusting mooring system using water weight bags comprising:

a line having a first end and a second end;

a pulley attached to a stationery object; and, a water weight bag made of a soft and flexible material, wherein said line is run through said pulley with said first end tied to said water weight bag and said second end tied to a floating object.

8. The automatically adjusting mooring system of claim 7 wherein said pulley is a single roller pulley.

9. The automatically adjusting mooring system of claim 7 wherein said pulley is a double roller pulley.

10. The automatically adjusting mooring system of claim 7 wherein the floating object is a boat.

11. The automatically adjusting mooring system of claim 7 wherein the floating object is a dock.

12. The automatically adjusting mooring system of claim 7 wherein the soft and flexible material further comprises a soft vinyl.

13. An automatically adjusting mooring and positioning system for a floating object comprising:

a front post;

a rear post;

a front pulley adapted to be attached to said front post;

a rear pulley adapted to be attached to said rear post;

a first line run through said rear pulley;

a second line run through said front pulley;

a front water weight bag adapted to be attached to said second line;

a rear water bag adapted to be attached to said first line;

said first line tied between the front of said floating object and said rear water bag;

said second line tied between the back of said floating object and said front water weight bag, whereby water levels in each of said water weight bags determine the position of said floating object.

* * * * *